US009644903B1

(12) United States Patent
Shyam et al.

(10) Patent No.: US 9,644,903 B1
(45) Date of Patent: May 9, 2017

(54) SHAPED RECESS FLOW CONTROL

(71) Applicant: The United States of America as represented by the Administrator of the National Aeronautics and Space Administration, Washington, DC (US)

(72) Inventors: Vikram Shyam, Cleveland, OH (US); Philip Poinsatte, Cleveland, OH (US); Douglas Thurman, Cleveland, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 576 days.

(21) Appl. No.: 13/904,513

(22) Filed: May 29, 2013

Related U.S. Application Data

(60) Provisional application No. 61/654,340, filed on Jun. 1, 2012.

(51) Int. Cl.

| | |
|---|---|
| ***F28F 23/00*** | (2006.01) |
| ***F15D 1/00*** | (2006.01) |
| ***F01D 9/06*** | (2006.01) |
| ***F01D 5/18*** | (2006.01) |
| ***F28F 13/18*** | (2006.01) |
| ***F28F 19/02*** | (2006.01) |

(52) U.S. Cl.

CPC ..... *F28F 23/00* (2013.01); *F15D 1/0005* (2013.01); *F01D 5/186* (2013.01); *F01D 5/187* (2013.01); *F01D 9/06* (2013.01); *F05D 2260/202* (2013.01); *F05D 2260/2212* (2013.01); *F05D 2260/2214* (2013.01); *F05D 2260/22141* (2013.01); *F28F 13/18* (2013.01); *F28F 13/185* (2013.01); *F28F 19/02* (2013.01)

(58) Field of Classification Search

CPC . F01D 9/06; F01D 5/186; F01D 5/187; F05D 2260/202; F05D 2260/2212; F05D 2260/2214; F05D 2260/22141; F28F 13/18; F28F 13/185; F28F 19/02

USPC ..... 416/96 R, 97 R; 415/115, 914

See application file for complete search history.

(56) References Cited

U.S. PATENT DOCUMENTS 4,650,138 A * 3/1987 Grose ..... B64C 21/10 138/38
5,337,568 A * 8/1994 Lee ..... F01D 5/18 416/236 R (Continued)

*Primary Examiner* — Justin Jonaitis
*Assistant Examiner* — Joel Attey
(74) *Attorney, Agent, or Firm* — Robert H. Earp, III

(57) ABSTRACT

One or more embodiments of techniques or systems for shaped recess flow control are provided herein. A shaped recess or cavity can be formed on a surface associated with fluid flow. The shaped recess can be configured to create or induce fluid effects, temperature effects, or shedding effects that interact with a free stream or other structures. The shaped recess can be formed at an angle to a free stream flow and may be substantially "V" shaped. The shaped recess can be coupled with a cooling channel, for example. The shaped recess can be upstream or downstream from a cooling channel and aligned in a variety of manners. Due to the fluid effects, shedding effects, and temperature effects created by a shaped recess, lift-off or separation of cooling jets of cooling channels can be mitigated, thereby enhancing film cooling effectiveness.

7 Claims, 15 Drawing Sheets

(56) References Cited

U.S. PATENT DOCUMENTS

| | | | | |
|---|---|---|---|---|
| 5,382,135 | A * | 1/1995 | Green | F01D 5/145 415/115 |
| 5,540,406 | A * | 7/1996 | Occhipinti | B63B 1/248 244/198 |
| 6,183,197 | B1 * | 2/2001 | Bunker | F01D 5/141 415/178 |
| 6,929,058 | B2 | 8/2005 | Liu et al. | |
| 6,984,100 | B2 | 1/2006 | Bunker et al. | |
| 7,207,772 | B2 * | 4/2007 | Johann | F01D 5/145 415/181 |
| 7,373,778 | B2 | 5/2008 | Bunker et al. | |
| 7,386,980 | B2 | 6/2008 | Green et al. | |
| 7,604,461 | B2 * | 10/2009 | Bonnet | F03D 1/0641 416/235 |
| 7,766,616 | B2 | 8/2010 | Baldauf et al. | |
| 7,791,025 | B2 | 9/2010 | Key | |
| 7,878,759 | B2 | 2/2011 | Mills et al. | |
| 7,997,868 | B1 | 8/2011 | Liang | |
| 2005/0286998 | A1 | 12/2005 | Lee et al. | |
| 2010/0288379 | A1 * | 11/2010 | Dahm | B64C 21/10 137/561 R |
| 2011/0305582 | A1 * | 12/2011 | Lee | F01D 5/186 416/97 R |

* cited by examiner

SHAPED RECESS FLOW CONTROL

CROSS-REFERENCE TO RELATED APPLICATIONS

This application claims the benefit of U.S. Provisional Patent Application, Ser. No. 61/654,340 entitled "V-Cess: A Novel Flow Control Method Using A Shaped Recess", filed on Jun. 1, 2012. The entirety of the above-noted application is incorporated by reference herein.

ORIGIN OF DISCLOSURE

The disclosure described herein was made by employees of the United States Government and may be manufactured and used by or for the Government for Government purposes without the payment of any royalties thereon or therefore.

BACKGROUND

Generally, a turbine engine has a compressor, a combustor, and a turbine or turbine airfoil. The compressor is upstream from the combustor and is configured to pressurize fluids, such as gases or air, for the combustor. The combustor can have a combustion chamber where fuel and the pressurized fluid are combined and combusted. The turbine is downstream from the combustor, extracts energy from the combustor, and is used to drive the compressor. One or more turbine blades of a turbine are turned by hot, combusted gas generated by the combustor, thereby driving the turbine engine.

As technology advances, turbine engine designers have endeavored to increase combustor exit temperatures and high-pressure turbine stage inlet temperatures to achieve improved efficiency and reduce fuel consumption. However, these increased temperatures can jeopardize the integrity of turbine components, such as the turbine blades. Since turbine performance corresponds to cooling of external surfaces of a turbine, such as a surface on a high-pressure side of a turbine blade, it is generally desirable to provide uniform cooling thereto. Accordingly, to mitigate failure of turbine blades resulting from excessive operating temperatures, film cooling may be incorporated into turbine blade designs.

In film cooling, cool air is bled from the compressor, ducted to one or more internal chambers of the turbine blades, and discharged via one or more cooling channels to form one or more cooling jets. For example, a cooling channel can be a hole which couples an internal chamber of a turbine blade to a surface of the turbine blade. To this end, cool air or gas which is cooler than a free stream can be passed from the compressor to an internal chamber of a turbine blade, to an external surface of the turbine blade, and take form as a cooling jet. As a result of the cooling jets, convective heat transfer to the surface of the turbine blade can be reduced. Cooling channels can have a round cross-section, and be oriented at an angle to an external surface of the turbine blade. These cooling jets can be configured to provide a thin, cool, insulating, boundary layer along the external surface of the turbine blade.

However, film cooling may not be effective when a cooling jet detaches, lifts off, or does not adhere to an external surface of a turbine blade. For example, at momentum ratios above about 0.5, a counter-rotating vortex pair, such as a kidney vortex, is often formed. This counter-rotating vortex pair can cause the cooling jet to separate or lift-off from the surface at a sufficiently high blowing ratio. When lift-off occurs, the cooling jet is lifted away from the surface of the turbine blade, thereby reducing film cooling effectiveness.

SUMMARY

This summary is provided to introduce a selection of concepts in a simplified form that are described below in the detailed description. This summary is not intended to be an extensive overview of the claimed subject matter, identify key factors or essential features of the claimed subject matter, nor is it intended to be used to limit the scope of the claimed subject matter.

One or more embodiments of techniques or systems for shaped recess flow control are provided herein. A shaped recess or cavity can be formed on a surface associated with fluid flow, such as a turbine blade of a turbine airfoil. The shaped recess can be configured to create or induce one or more fluid effects, one or more temperature effects, or one or more shedding effects which may interact with or impact a free stream flow or one or more additional flow structures, such as a cooling jet, for example. In one or more embodiments, the shaped recess can be a v-shaped recess (v-cess) or a portion of a v-cess. For example, the shaped recess can include one leg or a portion of a leg of a v-cess. Additionally, one or more legs of a v-cess or a portion of a v-cess can include steps, regions, phases, stages, contours, etc., such as staggered regions, non-linear regions, rounded regions, etc.

It will be appreciated that one or more characteristics or one or more attributes of a shaped recess can be adjusted based on one or more desired effects. For example, a depth, length, width, one or more angles associated with a shaped recess, placement, arrangement, etc. of a shaped recess can be adjusted. In other words, a variety of shaped recesses can be formed. Additionally, a shaped recess can be paired with one or more cooling channels or other structures. For example, a shaped recess, such as a v-cess, may interact with a cooling channel based on a position of the v-cess relative to the cooling channel. The shaped recess can be upstream or downstream of the cooling channel and can be placed at different coordinates to different effects.

In one or more embodiments, the shaped recess can be configured to introduce an amount of turbulence into a boundary layer between a surface and a free stream. For example, when a shaped recess is upstream from a cooling channel or film cooling channel, the shaped recess introduces turbulence that mitigates lift off of a cooling jet from the cooling channel. Because the cooling jet interacts with or combines with the boundary layer on the surface, turbulence from the shaped recess enhances the ability of the boundary layer to 'stick' to the surface.

One or more shaped recesses can be configured or arranged to mitigate a counter-rotating vortex pair or a kidney vortex such that an inverse counter-rotating vortex pair or an inverse kidney vortex is formed when a free stream passes over one or more of the shaped recesses. By mitigating or cancelling a counter-rotating vortex pair or a kidney vortex of a cooling jet, film cooling efficiency can be enhanced, because a likelihood that the cooling jet will lift off is reduced by interaction between the inverse counter-rotating vortex pair and the counter-rotating vortex pair.

Additionally, a shaped recess can be configured to restart a boundary layer on a surface associated with fluid flow. For example, a slow moving portion of a boundary layer can be swallowed by the shaped recess. This enables the boundary layer to have a faster velocity downstream of the shaped recess by contrast to a slower velocity upstream of the shaped recess. Additionally, it will be appreciated that this faster velocity effectively reduces the blowing ratio between the free stream and the boundary layer. This reduced blowing ratio generally helps keep a cooling jet or a boundary layer attached to the surface, thereby enhancing film cooling.

In one or more embodiments, a shaped recess coupled with a cooling channel downstream of the shaped recess can be configured to draw cool air from a cooling jet of the cooling channel upstream, because a horseshoe vortex associated with the cooling channel interacts with vortices associated with the shaped recess. Higher pressure from the horseshoe structure can push a portion of flow or cool air from the cooling jet back into the shaped recess, thereby enhancing film cooling.

Additionally, a shaped recess may cause stagnation pressure coupled with cooling channel to be lower than surrounding stagnation pressure, enabling coolant to spread laterally.

The following description and annexed drawings set forth certain illustrative aspects and implementations. These are indicative of but a few of the various ways in which one or more aspects are employed. Other aspects, advantages, or novel features of the disclosure will become apparent from the following detailed description when considered in conjunction with the annexed drawings.

DESCRIPTION OF THE DRAWINGS

Aspects of the disclosure are understood from the following detailed description when read with the accompanying drawings. It will be appreciated that elements, structures, etc. of the drawings are not necessarily drawn to scale. Accordingly, the dimensions of the same may be arbitrarily increased or reduced for clarity of discussion, for example.

DETAILED DESCRIPTION

Figure 1:
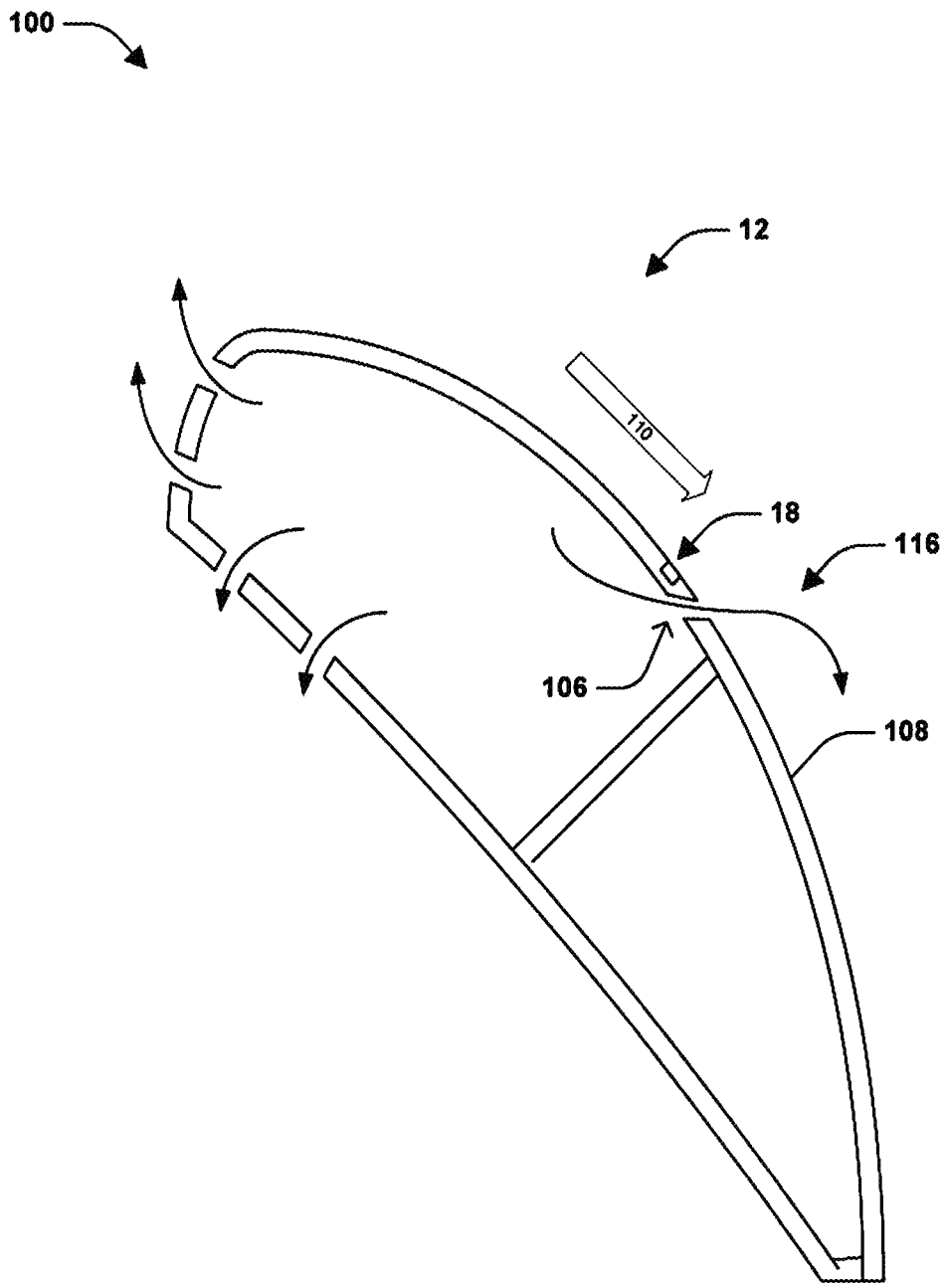
FIG. 1 is an illustration of a cross-sectional view of an example turbine blade, according to one or more embodiments.

Embodiments or examples, illustrated in the drawings are disclosed below using specific language. It will nevertheless be understood that the embodiments or examples are not intended to be limiting. Any alterations and modifications in the disclosed embodiments, and any further applications of the principles disclosed in this document are contemplated as would normally occur to one of ordinary skill in the pertinent art.

It will be appreciated that for one or more of the figures herein, one or more boundaries are drawn with different heights, widths, perimeters, aspect ratios, shapes, etc. relative to one another merely for illustrative purposes, and are not necessarily drawn to scale. For example, dashed or dotted lines can be used to represent different boundaries, and if the dashed and dotted lines were drawn on top of one another they would not be distinguishable in the figures, and thus are drawn with different dimensions or slightly apart from one another so that they are distinguishable from one another. As another example, where a boundary is associated with an irregular shape, the boundary, such as a box drawn with a dashed line, dotted lined, etc., does not necessarily encompass an entire component in one or more instances. Conversely, a drawn box does not necessarily encompass merely an associated component, in one or more instances, but encompasses at least a portion of one or more other components as well.

It will be appreciated that "surface", as used herein can include a top surface, a bottom surface, an interior surface, an exterior surface, or the like, etc.

Generally, a turbine engine is driven by passing hot air from a combustor to one or more turbines or turbine blades, causing the turbines to rotate. A high pressure side of the turbine blades faces the combustor, while a low pressure side of the turbine blades faces the exhaust. FIG. 1 is an illustration of a cross-sectional view 100 of an example turbine blade, according to one or more embodiments. In FIG. 1, a turbine blade 12 includes a surface 108, a cooling channel 106, and a shaped recess 18. Cooling channel 106 couples an interior of the turbine blade 12 with an exterior of the turbine blade 12. Coolant fluid, such as relatively cool air, from the compressor can be ducted to the surface 108 of the turbine blade 12 to provide a cooling jet 116. In other words, gas which is cooler than the free stream 110 can be passed onto the external surface via slots or holes, such as cooling channel 106. Additionally, one or more different cooling channels (not labeled) may be used for different portions of the turbine blade 12, such as areas associated with hot spots or higher pressure, for example.

It is generally desirable to introduce the cooling jet 116 into a boundary layer without a substantial increase in turbulence. The cooling jet 116 can form a cool boundary layer on the surface 108 of the turbine blade 12. In other words, the cooling jet 116 can lay a cool film on the surface 108 of the turbine blade 12 such that the cool film or boundary layer cools the surface 108 relative to a free stream 110. For example, the cooling jet 116 can provide film cooling by reducing heat transfer from the free stream 110 to the surface 108 of the turbine blade 12. Because the cooling jet 116 includes gas which is cooler than the free stream 110, a temperature of the surface 108 of the turbine blade 12 is reduced.

Additionally, it is generally desirable to enhance film cooling effectiveness and to mitigate separation. With regard to film cooling effectiveness, it is desired to have the temperature of the surface of the turbine ($T_{surface}$) be substantially equal to the temperature of the coolant ($T_{coolant}$) or the temperature of the cooling jet 116. Because of this, it is desirable to have the cooling jet 116 substantially attached to the surface 108 of the turbine blade 12. Further, it may also be desirable to reduce coolant usage or a number of cooling channels, because coolant or relatively cool fluid is taken from the compressor to facilitate film cooling, thereby reducing an amount of fluid seen by the combustor. In other words, when cooling is taken from the compressor, work done on the fluid by the compressor is not utilized for combustion.

Separation occurs when fluid, such as air, meets an obstruction and does not follow a streamline of the obstruction. For example, the fluid may become detached from a surface of an object, increase drag, or cause a leading edge to reverse flow direction.

Pressure within the cooling channel 106 or internal to the turbine blade 12 is often greater than the pressure exterior to the turbine blade 12 or the high pressure side of the turbine blade 12 to facilitate coolant flow from the inside of the turbine to the outside of the turbine. As the internal pressure increases, a likelihood of coolant jet 116 lift off may increase, where the coolant jet 116 detaches from the surface 108, thereby decreasing film cooling efficiency. In one or more embodiments, the shaped recess 18 can enhance film cooling effectiveness by introducing a small amount of turbulence that mitigates lift off of the cooling jet 116, thereby keeping the cooling jet 116 attached to the surface 108 of the turbine blade 12. The shaped recess 18 can mitigate a counter rotating vortex pair, mitigate a kidney vortex, draw coolant upstream from the cooling channel 116, split a flow into a high energy stream and a low energy stream, or introduce shedding, thereby mitigating separation and lift off.

Figure 2:
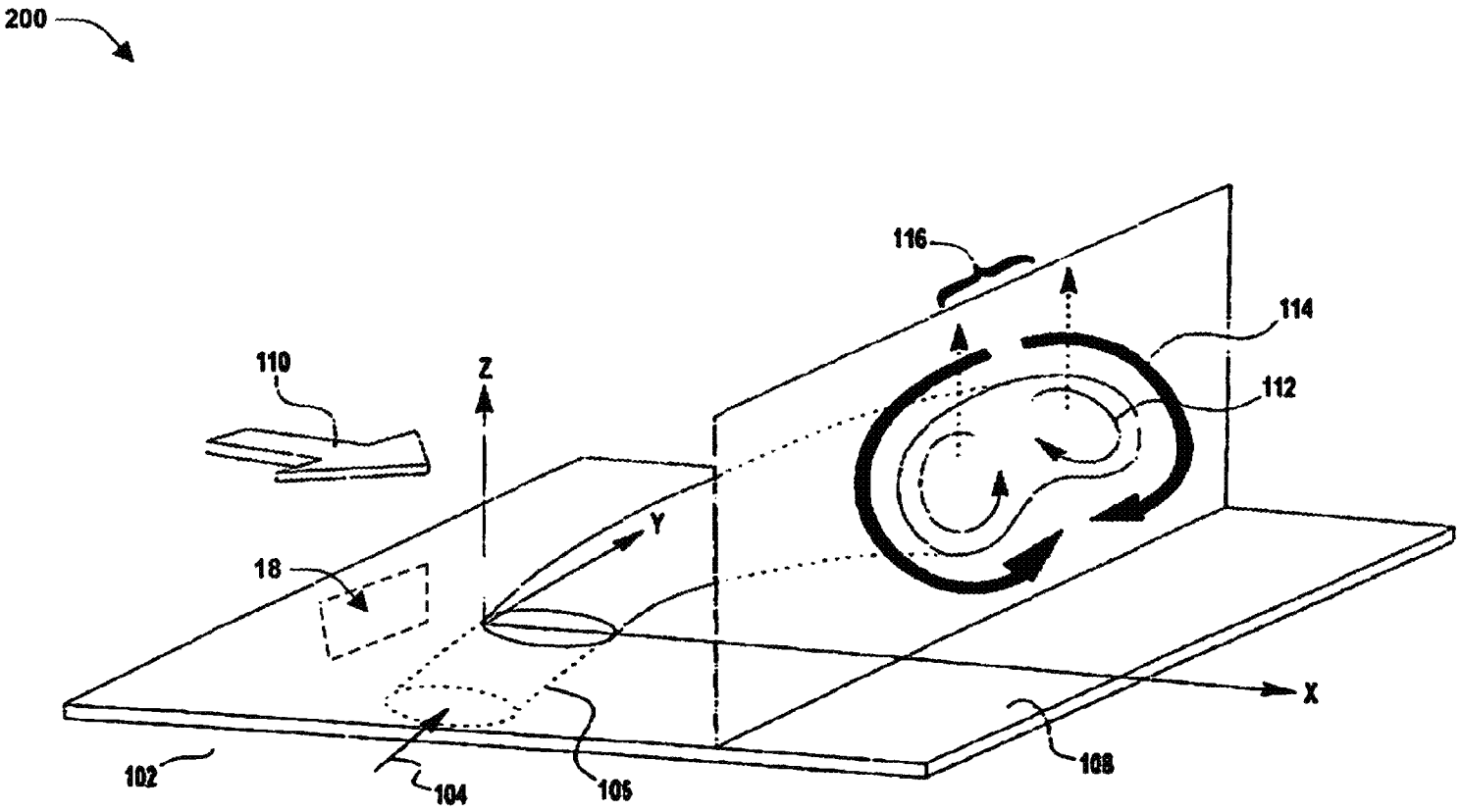
FIG. 2 is an illustration of example fluid flow from a cooling channel and a corresponding cooling jet, according to one or more embodiments.

FIG. 2 is an illustration of example fluid flow 200 from a cooling channel and a corresponding cooling jet, according to one or more embodiments. FIG. 2 illustrates a counter rotating vortex pair with respect to a cooling channel arrangement 102. Coolant 104, such as coolant fluid, gas, cool air, etc., is provided by cooling channel 106. The cooling channel can be inclined or at an angle with respect to a surface 108, a main flow, or a free stream 110 of the arrangement 102. In one or more embodiments, the cooling channel 106 can be at an angle with a surface or flat plate model, for example. Because of this, coolant is distributed downstream from the cooling channel 106. It can be seen that a cross flow or a free stream 110 of gas passes over the surface 108 of the arrangement 102. As a result of the cooling channel 106, cooling jet 116, and the free stream 110, a vortex structure, such as a counter rotating vortex pair 112 of coolant 104 is formed. The counter rotating vortex pair 112 is associated with a vorticity field, indicated by curved arrows 114, which may lift the cooling jet 116 away from the surface 108 of the arrangement 102, as indicated by the upward pointing arrows associated with 116.

In some embodiments, a shaped recess 18 can be formed upstream or downstream from a cooling channel to mitigate lifting of the cooling jet 116 caused by the counter rotating vortex pair 112. For example, the shaped recess 18 can be configured to introduce one or more fluid effects, one or more temperature effects, or one or more shedding effects that enhance film cooling effectiveness or mitigate separation.

Figure 3:
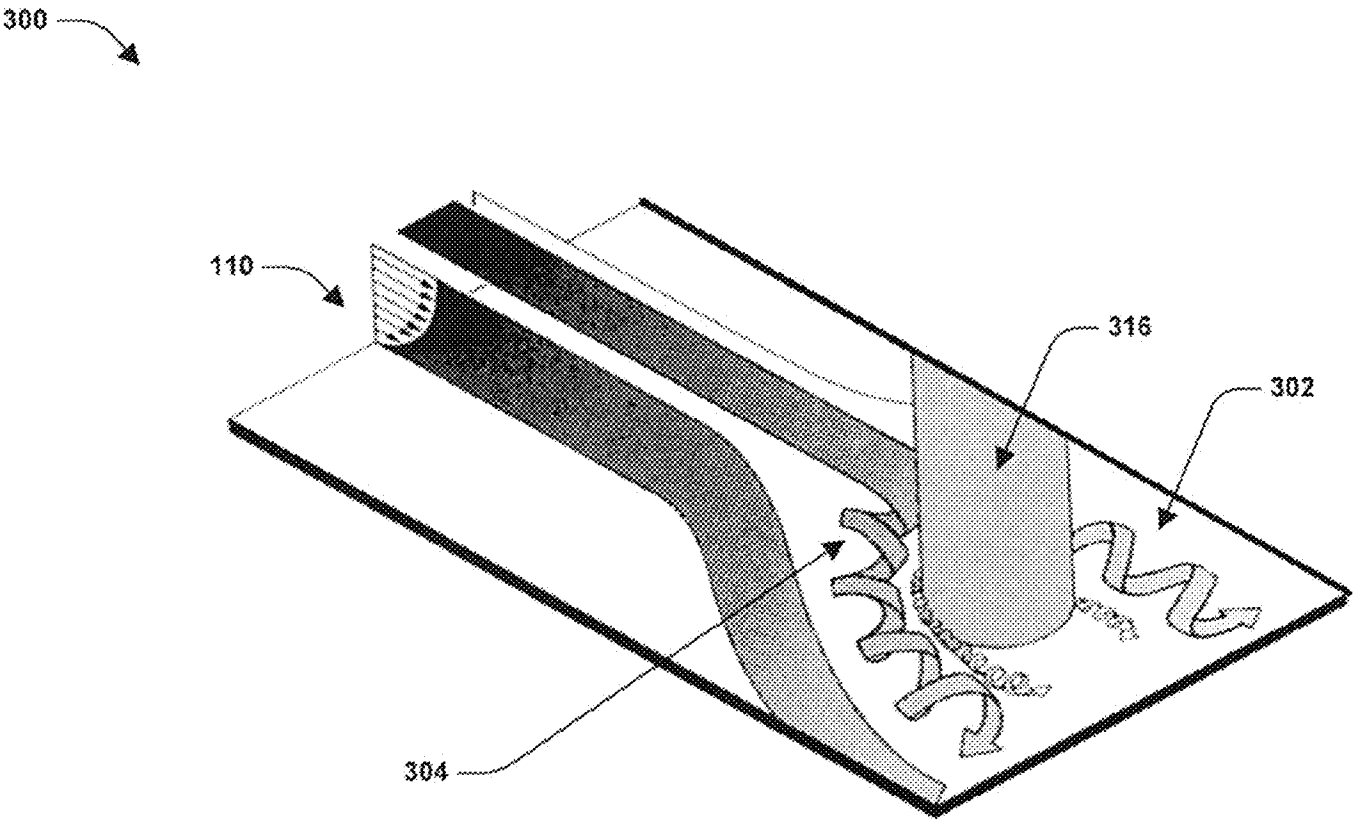
FIG. 3 is an illustration of example fluid flow associated with a horseshoe vortex, according to one or more embodiments.

FIG. 3 is an illustration of example fluid flow 300 associated with a horseshoe vortex, according to one or more embodiments. A cooling jet, such as cooling jet 316 may be viewed as an obstruction with respect to a free stream flow 110 because the cooling jet 316 is travelling in a substantially different direction than the free stream flow 110. Because the cooling jet 316 is treated as an obstruction, a horseshoe structure 302 may be formed around the cooling jet 316. As a result, energy loss may occur when kinetic energy travels backwards against a main flow or free stream flow 110, as seen at an apex 304 of the horseshoe structure 302, for example. It will be appreciated that a shaped recess, such as shaped recess 18 of FIG. 1, can be formed with respect to the cooling jet 316 or an associated cooling channel to utilize the horseshoe structure 302 to enhance film cooling.

Figure 4:
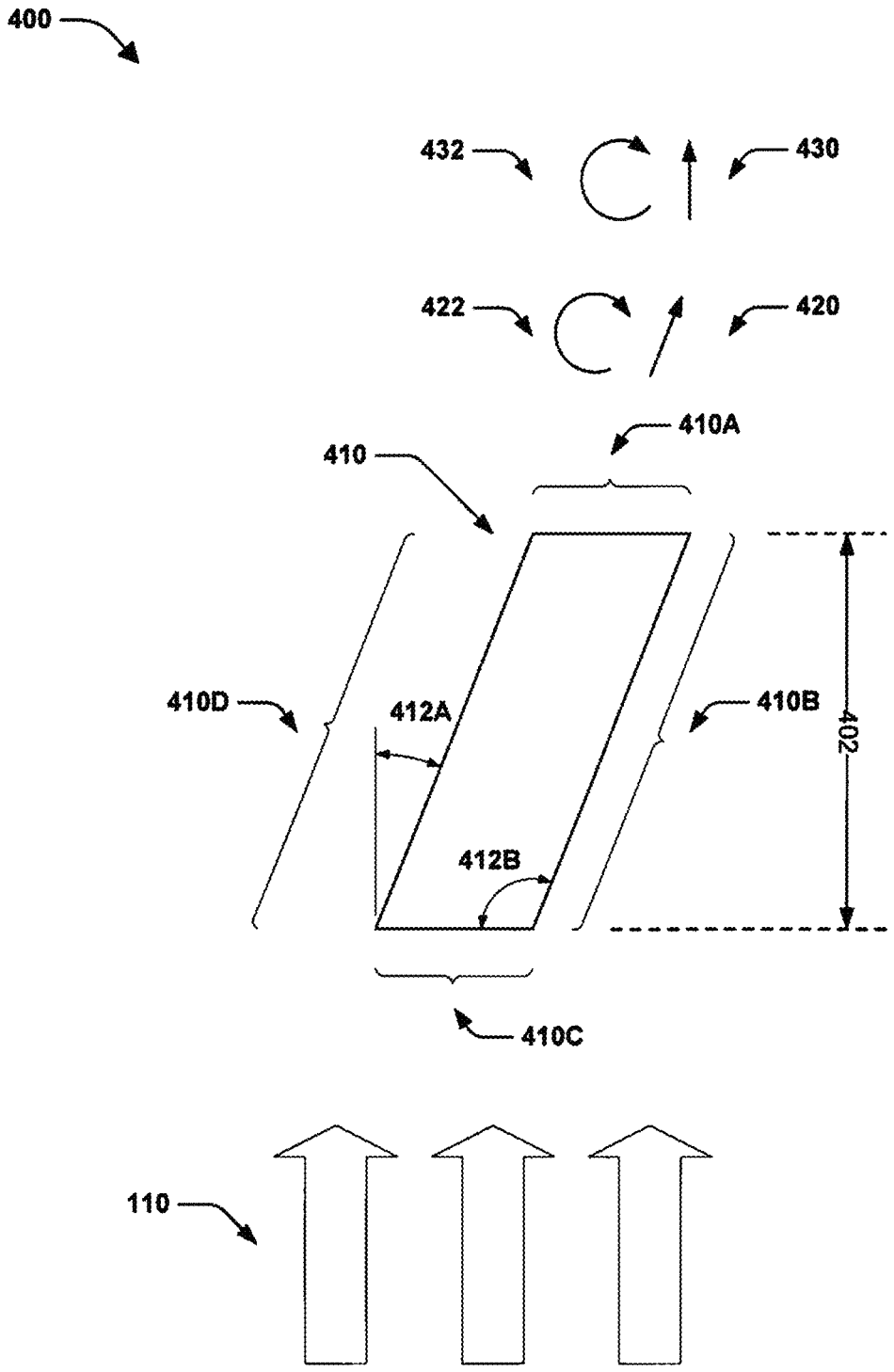
FIG. 4 is an illustration of a top-down view of an example shaped recess, according to one or more embodiments.

FIG. 4 is an illustration of a top-down view 400 of an example shaped recess, according to one or more embodiments. The shaped recess 410 or cavity of FIG. 4 can include one half, at least a portion of, or one leg of a "V" shape or a leg of a "V" shape. The shaped recess 410 can be formed to be a variety of different shapes by adjusting one or more parameters associated with the shaped recess 410. For example, one or more lengths, widths, depths, or angles associated with a shaped recess, such as recess 410 can be adjusted to form different shaped recesses. The shaped recess 410 of FIG. 4 has four sides or edges 410A, 410B, 410C, and 410D. However, it will be appreciated that other shapes or number of sides or edges are contemplated. The shaped recess 410 can be formed with different lengths by adjusting 410B and 410D. Similarly, different widths can be formed by adjusting 410A and 410C.

Generally, it is desirable for the shaped recess 410 to be long enough such that free stream flow 110 views the shaped recess 410 as an obstacle. Accordingly, a length 402 or a length of 410B and 410D of the shaped recess 410 can be adjusted based on an estimated velocity of the free stream flow 110 or an estimated velocity of an associated boundary layer.

In one or more embodiments, the shaped recess 410 can be formed at an angle 412A to a direction of a free stream flow 110. The angle 412A of the recess 410 with reference to the free stream flow 110 can impact a direction of a vorticity field 420 downstream from the shaped recess 410. It can be seen that a direction of a vorticity field 430 further downstream from 420 is substantially aligned with the free stream flow 110. In other words, a vortex associated with the shaped recess 410 generally starts travelling in a direction aligned with a leg of a "V", but eventually straightens out downstream. Vortices 422 can be seen to be travelling generally in direction 420, while vortices 432 generally travel in direction 430. In one or more embodiments, the vortices 422 and 432 have a helical pattern and are associated with a frequency. In this way, one or more shaped recesses, such as the shaped recess 410 of FIG. 4, are configured to create a vorticity field that substantially mitigates at least a portion of the counter rotating vortex pair 112 of FIG. 2. In other words, at least a portion of an inverse vorticity field may be created to mitigate a vorticity field of a counter-rotating vortex pair, such as a kidney vortex generally inherent in the interaction between the coolant jets flowing from cooling channels and a cross flow of a free stream of heated fluid or gas flowing across a surface of an arrangement.

Additionally, one or more arrangements, pairings, or variations including a shaped recess and a structure, such as a cooling channel, may be formed. For example, a shaped recess can be formed or disposed upstream from, downstream from, or adjacent to a cooling channel, as described herein in FIG. 14. The shaped recess 410 can thus enable a cooling jet from a cooling channel to form a film of coolant along a surface of an arrangement. In this way, a counter rotating vortex pair generally associated with an interaction between cross flow of a free stream gas and the cooling jet from the cooling channel can be substantially mitigated allowing cooling to better adhere to the surface of the arrangement. The shaped recess 410 can also mitigate mixing of hot gases and coolant within a boundary layer, thereby improving film cooling efficiency such that $T_{surface}$ is closer to $T_{coolant}$.

A shaped recess, such as shaped recess 410, can be configured to introduce turbulence into a boundary layer between a surface of a configuration and a free stream flow 110. For example, a small amount of turbulence may help a boundary layer, such as a boundary layer injected with cool air from a cooling jet, to stick to a surface of an arrangement. In this way, a shaped recess can facilitate a transition from a laminar boundary layer to a turbulent boundary layer.

In one or more embodiments, a shaped recess, such as shaped recess 410, can be configured to create one or more shedding effects. For example, the shaped recess 410 can cause cavity shedding, wake shedding, shear layer shedding, or one or more other shedding modes, etc. In this way, shedding of vortices may occur at various frequencies, thereby energizing boundary layers and mitigating separation, for example.

A component, such as a turbine blade of a turbine airfoil can comprise a surface and the shaped recess 410 of FIG. 4. The shaped recess 410 can be within the surface of the component. The shaped recess 410 can comprise one or more edges (e.g., 410A, 410B, 410C, and 410D) and a depth (not shown), and be at an angle 412A to a direction of a free stream flow 110.

Figure 5:
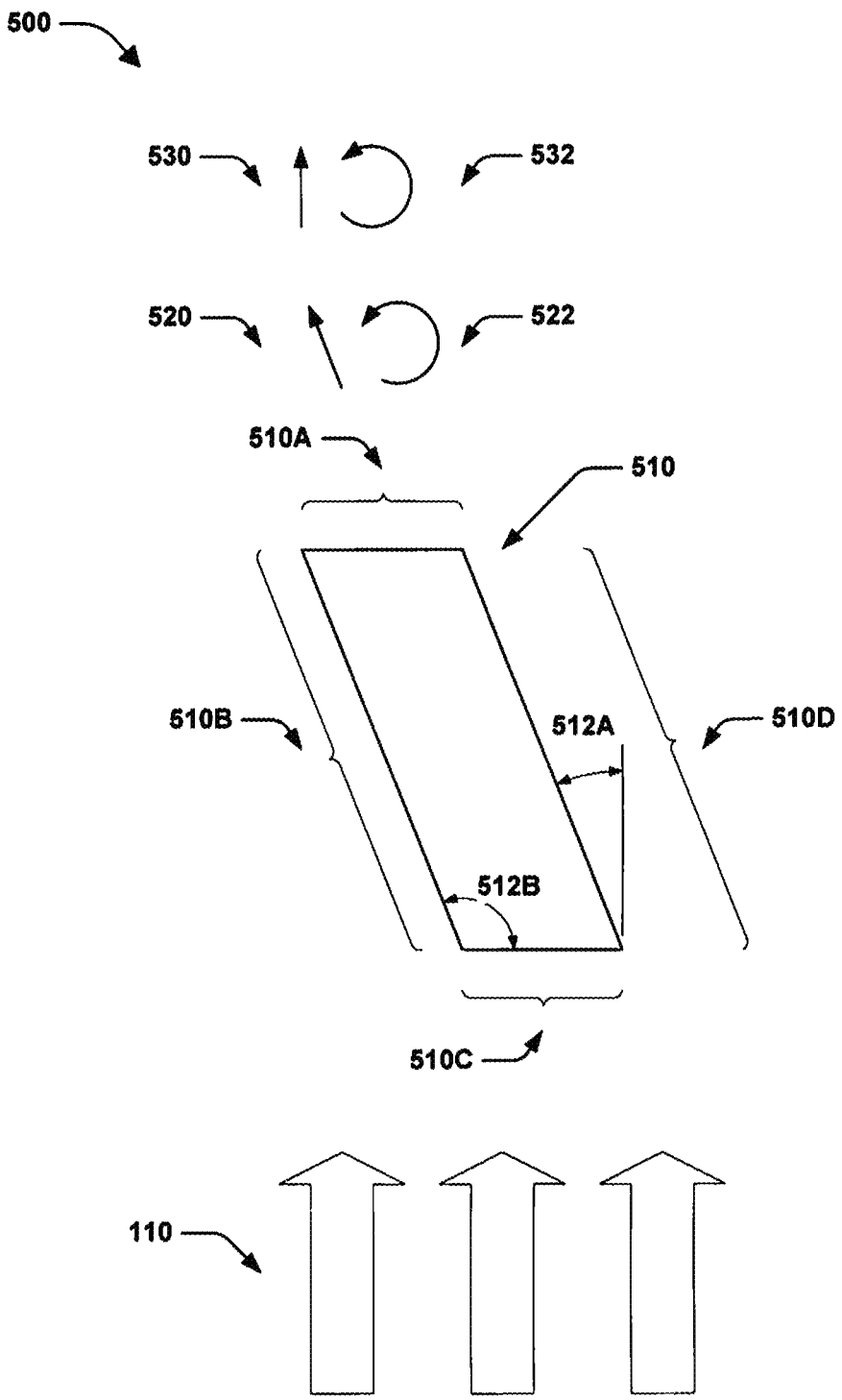
FIG. 5 is an illustration of a top-down view of an example shaped recess, according to one or more embodiments.

FIG. 5 is an illustration of a top-down view 500 of an example shaped recess, according to one or more embodiments. It will be appreciated that FIG. 5 is similar to FIG. 4, except that the shaped recess 510 of FIG. 5 is a mirror image of the shaped recess 410 of FIG. 4. Accordingly, fluid effects for FIG. 5 are generally reversed with respect to FIG. 4. The shaped recess 510 of FIG. 5 can include one half, a portion of, or one leg of a "V". For example, the shaped recess can have four sides and four corresponding lengths 510A, 510B, 510C, and 510D. The shaped recess 510 can be formed at an angle 512A to a free stream flow 110. As a result of the free stream flow 110 passing over the shaped recess 510, a vortex 522 may be formed that travels in direction 520, eventually drifting along 530, represented by vortex 532.

Figure 6:
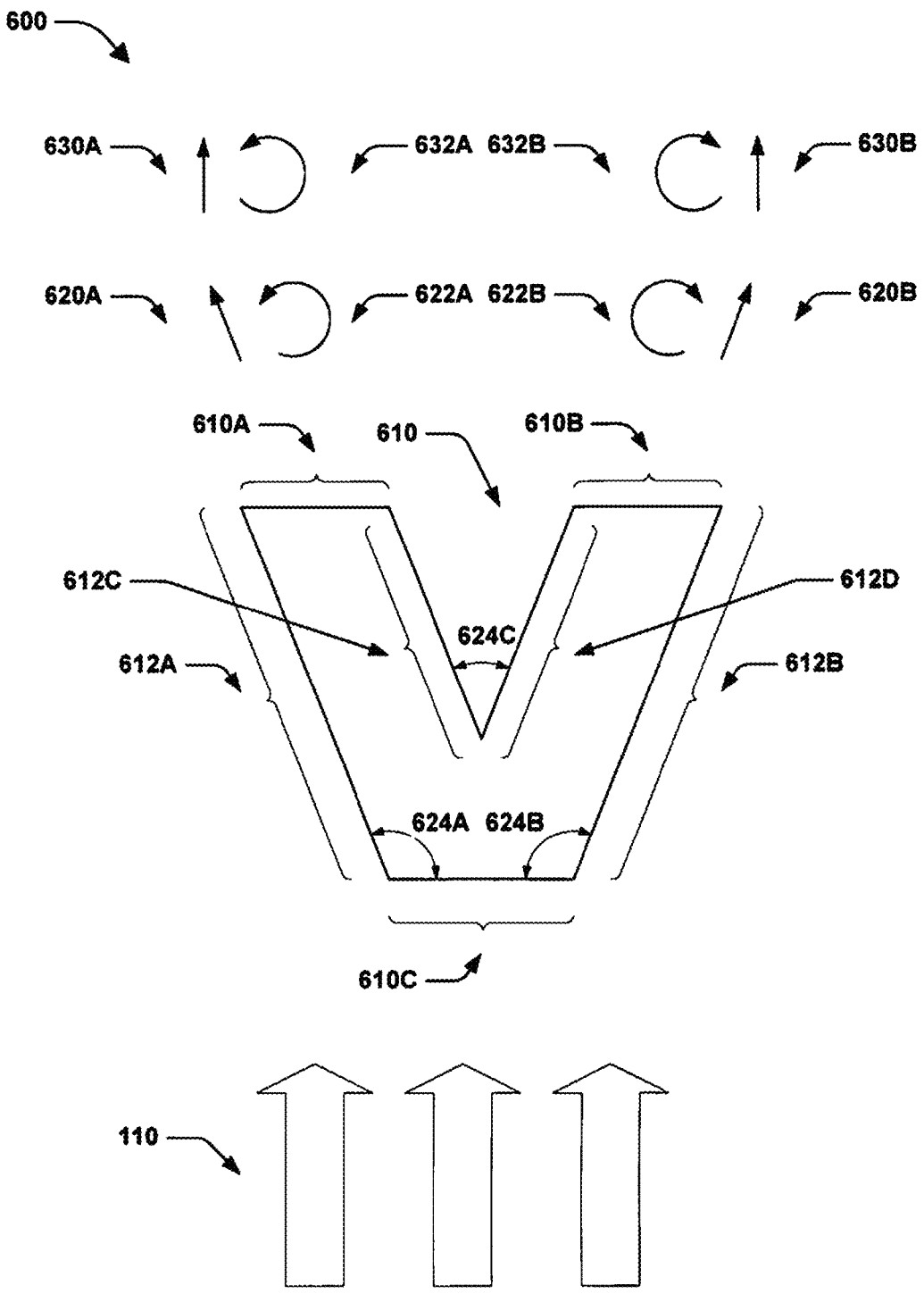
FIG. 6 is an illustration of a top-down view of an example shaped recess, according to one or more embodiments.

FIG. 6 is an illustration of a top-down view 600 of an example shaped recess, according to one or more embodiments. The shaped recess 610 of FIG. 6 can include a substantially "V" shaped recess or v-cess. In one or more embodiments, v-cess 610 can be formed to have an interior angle 624C. The v-cess 610 can have one or more edges or lengths 610A, 610B, 610C, 612A, 612B, 612C, or 612D. By adjusting the aforementioned lengths, angles 624A, 624B, and 624C may be altered concurrently. It will be appreciated that the v-cess 610 of FIG. 6 may be a combination of the shaped recess 410 of FIG. 4 and the shaped recess 510 of FIG. 5. Additionally, vortices 622A, 632A, 622B, and 632B may follow 620A, 630A, 620B, and 630B. In other words, when the free stream flow 110 passes over the v-cess 610, a branch is formed at 620A and a second branch is formed at 620B. These two branches move downstream at 630A and 630B. In one or more embodiments, v-cess 610 is configured such that free stream flow 110 treats the v-cess 610 as an obstacle or an obstruction. For example, the v-cess 610 may be formed with a length, width, or depth, such that free stream flow 110 or an associated boundary layer may be swallowed within a portion of the v-cess when passing over such a configuration.

In one or more embodiments, a shaped recess, such as v-cess 610 causes a low temperature region between legs of the v-cess 610 and high temperature regions downstream of the legs of the v-cess 610. For example, this may be due to the vorticity setup by the v-cess 610. Slower moving, low energy fluid from a cavity within the v-cess 610 can be pulled on a surface between the legs of the v-cess 610. As a result, an area away from the surface of the central region between the legs of the v-cess 610 can contain a higher energy stream than steams above or upstream of the legs of the v-cess 610.

Figure 7:
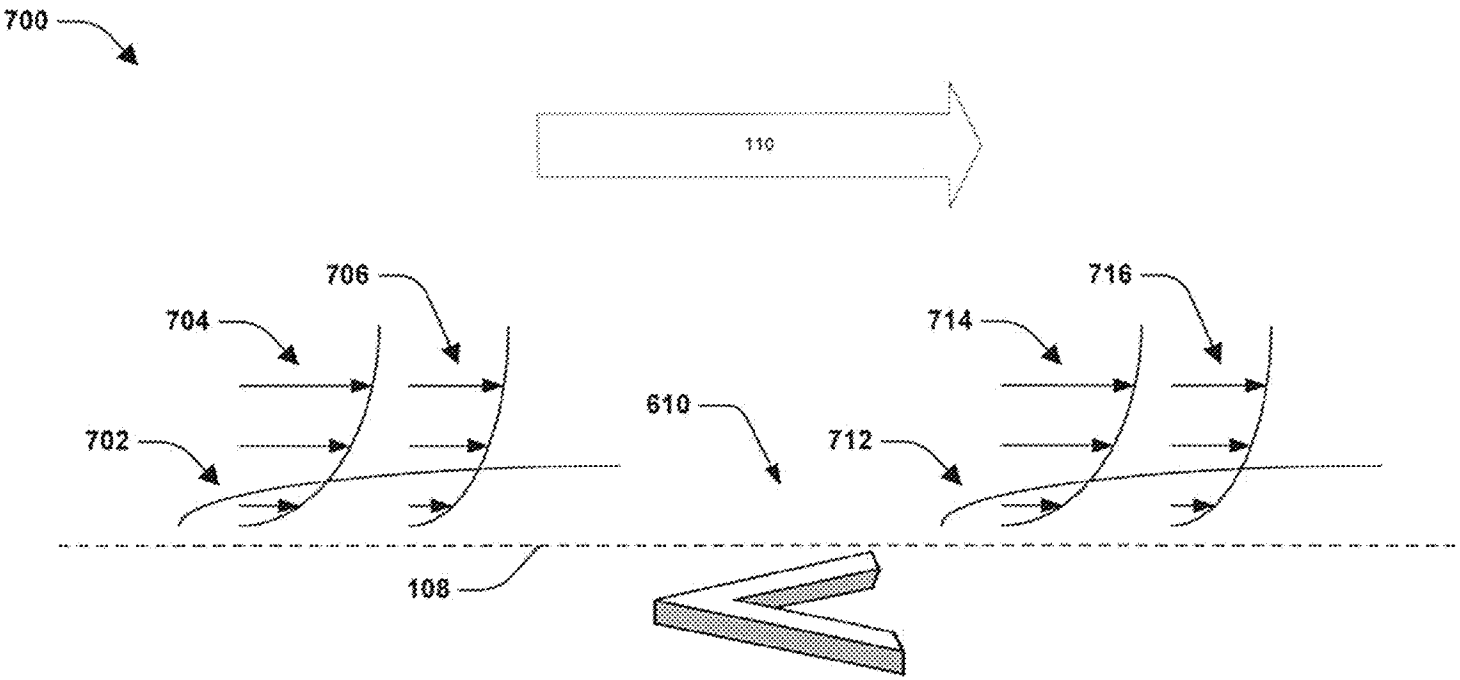
FIG. 7 is an illustration of an example height versus flow velocity diagram with relation to a "V" shaped recess (v-cess), according to one or more embodiments.

FIG. 7 is an illustration of an example height versus flow velocity diagram 700 with relation to a "V" shaped recess (v-cess), according to one or more embodiments. In one or more embodiments, a shaped recess, such as the v-cess 610 of FIG. 7, facilitates a restarting of a boundary layer, such as boundary layer 712. For example, a first boundary layer 702 is upstream from the v-cess 610 and travelling substantially in the same direction as free stream flow 110. As the first boundary layer 702 continues downstream, it increases in thickness, and is associated with a decrease in a time-average velocity profile, such as from 704 to 706, for example. This means that the velocity at 706 is less than the velocity at 704 because a portion of the boundary layer 702 'sticks' to the surface 108.

The v-cess 610 enables the boundary layer to restart at 712 because a slow moving portion of the boundary layer 702 closer to the surface 108 may be swallowed by the v-cess 610. This enables a faster moving portion of the boundary layer (e.g., as indicated by the top arrows of 704 and 706) to form boundary layer 712.

Generally, when a faster moving flow sees structure, such as a vortex, cooling jet, recess, etc., the faster moving flow treats the structure as a 'bump'. In this scenario, the legs of the v-cess 610 are treated as a bump such that a faster moving flow or free stream flow 110 is funneled between or around the legs of the v-cess. For example, velocity downstream of v-cess 610 and between legs of the v-cess 610 can be increased. In other words, the v-cess 610 may increase the velocity of boundary layer 712, thereby decreasing a blowing ratio between the free stream flow 110 and the boundary layer 712. As a result of this decrease in the blowing ratio, an associated cooling jet is less likely to detach. Accordingly, a shaped recess can be used to split incoming flows from a free stream 110 and a cooling jet, for example, into a high energy stream and a low energy stream, thereby mitigating lift off or separation of the cooling jet. In this scenario, the boundary layer 712 is the low energy stream and the free stream 110 is the high energy stream.

Figure 8:
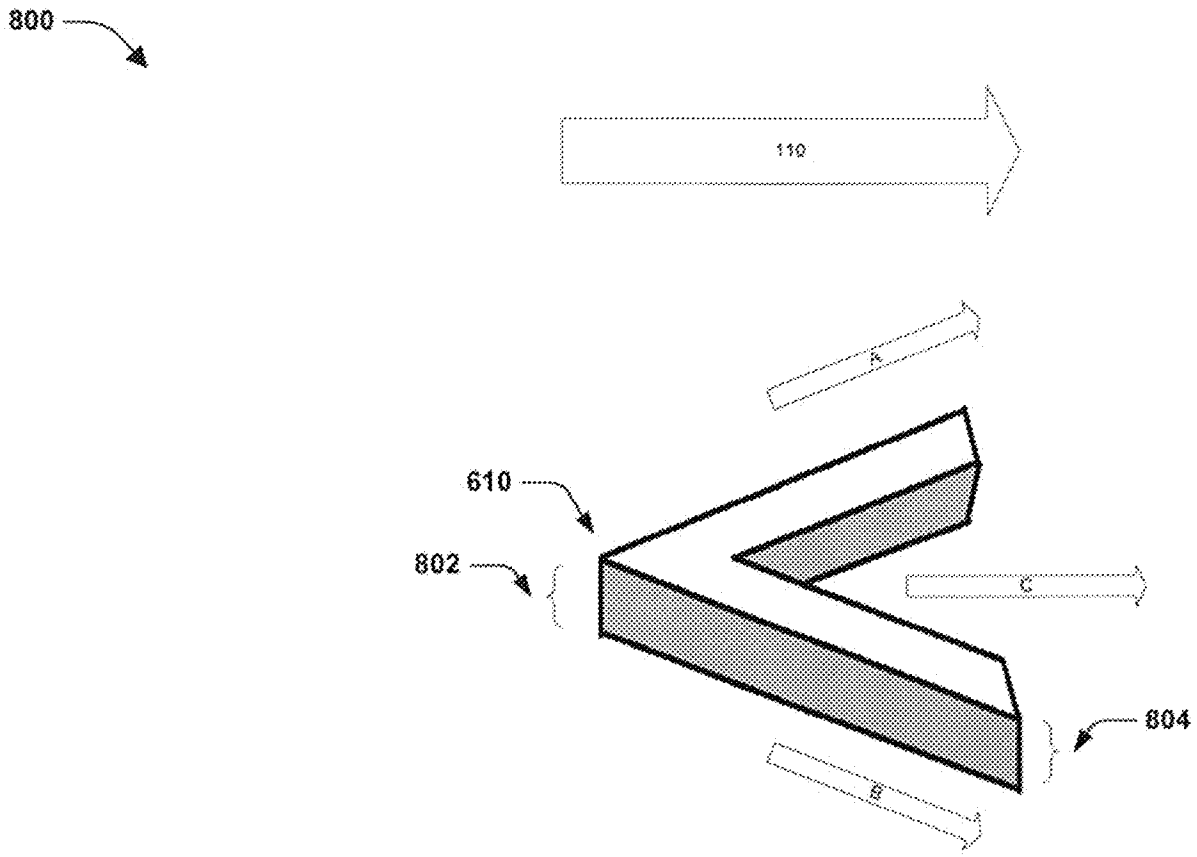
FIG. 8 is an illustration of a perspective view of an example "V" shaped recess (v-cess), according to one or more embodiments.

FIG. 8 is an illustration of a perspective view 800 of an example "V" shaped recess (v-cess), according to one or more embodiments. A shaped recess, such as v-cess 610 can be formed to have a first depth 802 at a first portion of the v-cess 610 and a second depth 804 at a second portion of the v-cess 610. In one or more embodiments, the length to depth ratio of a shaped recess is greater than 4:1 or 5:1. It may be advantageous to vary the depths 802 and 804 such that the shallower location is closer to a paired or coupled cooling channel (not shown). In other words, the depth of a shaped recess may not necessarily be uniform or may have some variation, for example. A shaped recess with the shallow location closer to a paired cooling channel would generally be less sensitive to an incoming boundary layer from upstream, for example.

Generally, it is desirable for at least a portion of a shaped recess to be deep enough such that a slow moving portion of flow, such as from a boundary layer, can be swallowed by the shaped recess as a free stream flow passes over the shaped recess. Accordingly, a portion of fluid may be swallowed by the v-cess 810 as a free stream 110 passes over the v-cess 610. As a result, the v-cess 610 is configured to restart a boundary layer downstream from the v-cess 610, as described in FIG. 7. It will be appreciated that the swallowing or restarting associated with the boundary layer is based on one or more boundary layer characteristics, such as velocity of the boundary layer, a height of the boundary layer, or one or more shaped recess characteristics, such as a length, width, or depth of the shaped recess. One or more vortices may be formed as a result of a shaped recess, such as v-cess 610, based on cavity flow.

Additionally, an angle of a wall of the shaped recess, such as 802 or 804, can be adjusted to create a desired effect, more turbulence, less turbulence, etc. Further, the depths 802 and 804 of a shaped recess can be adjusted such that the shaped recess may be or may not be a resonating cavity.

It will be appreciated that because legs of the v-cess 610 may be treated as an obstacle by the free stream flow 110, flows "A", "B", and "C" may be formed.

Figure 9:
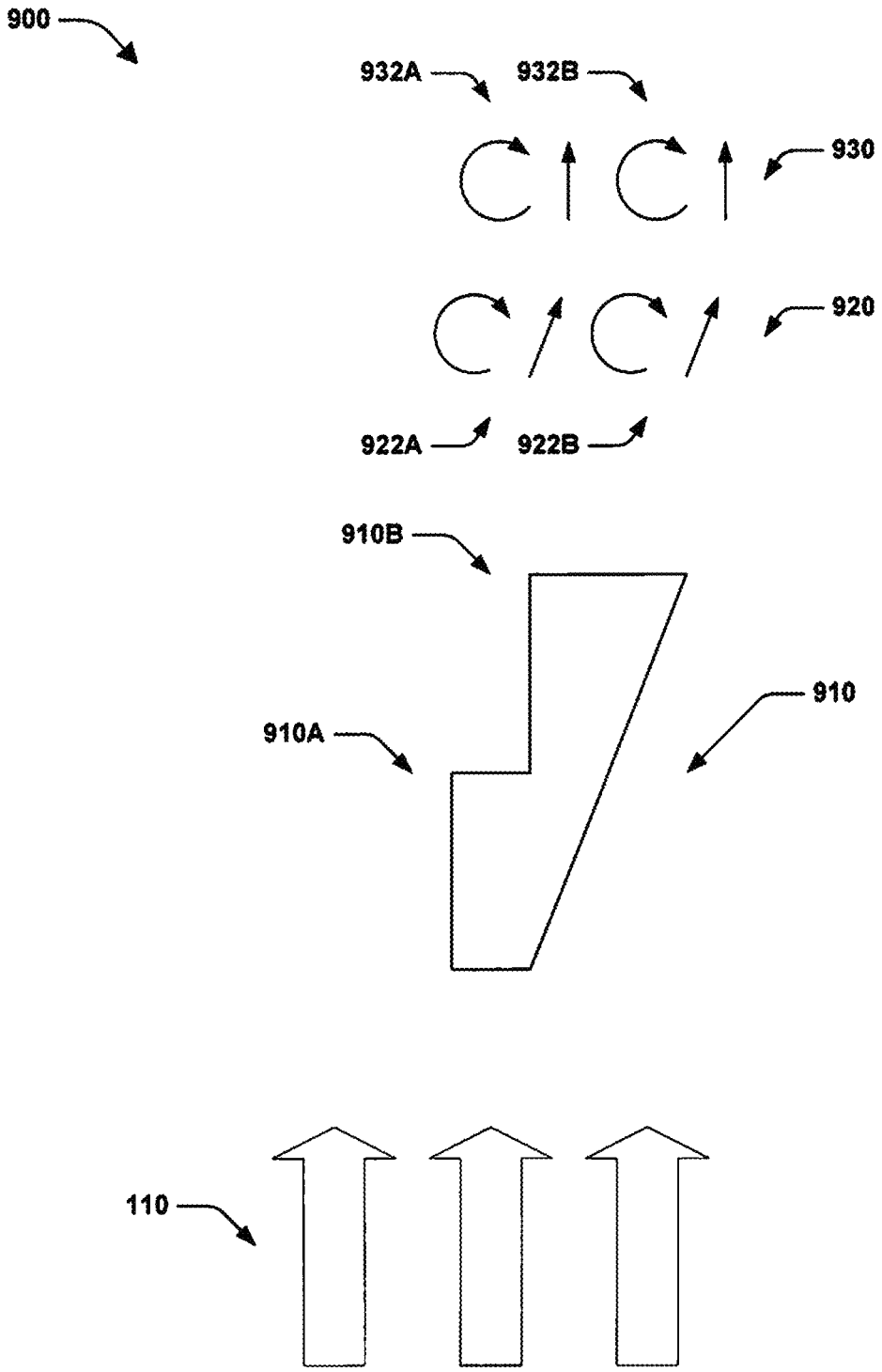
FIG. 9 is an illustration of a top-down view of an example shaped recess, according to one or more embodiments.

FIG. 9 is an illustration of a top-down view 900 of an example shaped recess, according to one or more embodiments. The shaped recess 910 of FIG. 9 can include one or more stages 910A and 910B or staggered regions, for example. According to one or more aspects, one or more of the stages 910A and 910B or one or more of the staggered regions can be linear, and include sharp corners. In other words, one or more of the stages of a shaped recess may be associated with a non-linear region, a rectangular region, a curved region, phases, stages, contours, etc. For example, respective corners or stages 910A and 910B may induce or create one or more corresponding vortex structures, such as 922A and 922B travelling along 920. Downstream, 932A and 932B travel along 930, rather than 920. That is, one or more of the stages of the shaped recess configured to create a vorticity field downstream of the shaped recess.

Figure 10:
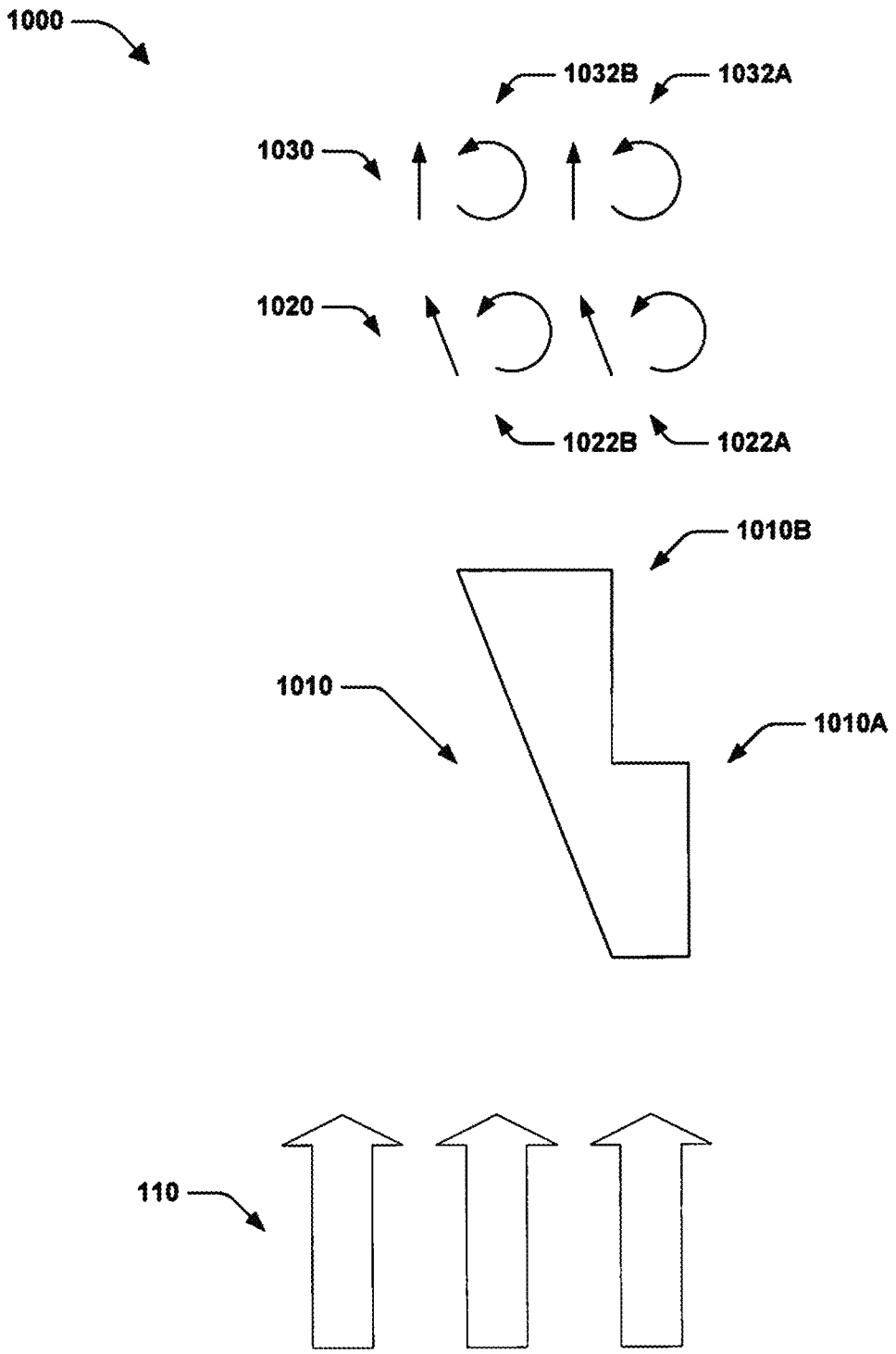
FIG. 10 is an illustration of a top-down view of an example shaped recess, according to one or more embodiments.

FIG. 10 is an illustration of a top-down view 1000 of an example shaped recess, according to one or more embodiments. The shaped recess 1010 of FIG. 10 can include one or more stages 1010A and 1010B or staggered regions, for example. It will be appreciated that FIG. 10 is similar to FIG. 9, except that the shaped recess 1010 of FIG. 10 is a mirror image of the shaped recess 910 of FIG. 9. Accordingly, fluid effects for FIG. 10 are generally reversed with respect to FIG. 9.

Figure 11:
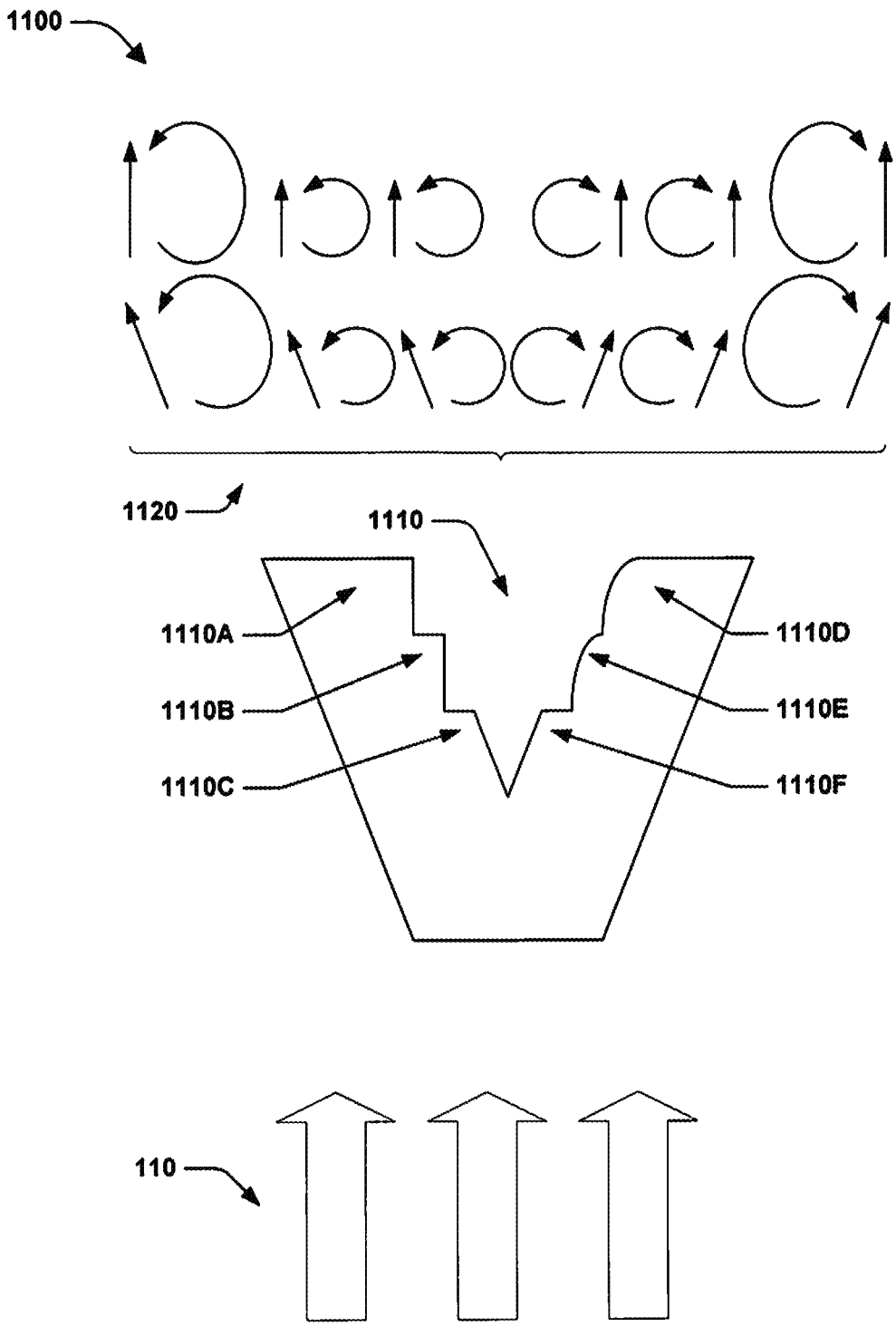
FIG. 11 is an illustration of a top-down view of an example shaped recess, according to one or more embodiments.

FIG. 11 is an illustration of a top-down view 1100 of an example shaped recess, according to one or more embodiments. The shaped recess 1110 of FIG. 11 can include one or more stages 1110A, 1110B, 1110C, 1110D, 1110E, and 1110F or staggered regions, steps, phases, etc., for example. According to one or more aspects, one or more of the stages, regions, phases, stages, contours, etc. 1110A, 1100B, and 1100C or one or more of the staggered regions can be linear. According to one or more aspects, one or more of the stages 1110D, 1100E, and 1100F can be non-linear, rounded, arced, etc. It will be appreciated that a leg of a v-cess or shaped recess may be configured to have a combination of linear and non-linear steps, regions, phases, stages, contours, etc., such as in an alternating pattern (e.g., squared-rounded-squared-rounded, etc.). As a result of one or more of the stages 1110A, 1110B, 1110C, 1110D, 1110E, or 1110F vorticity field 1120 may be formed.

Figure 12:
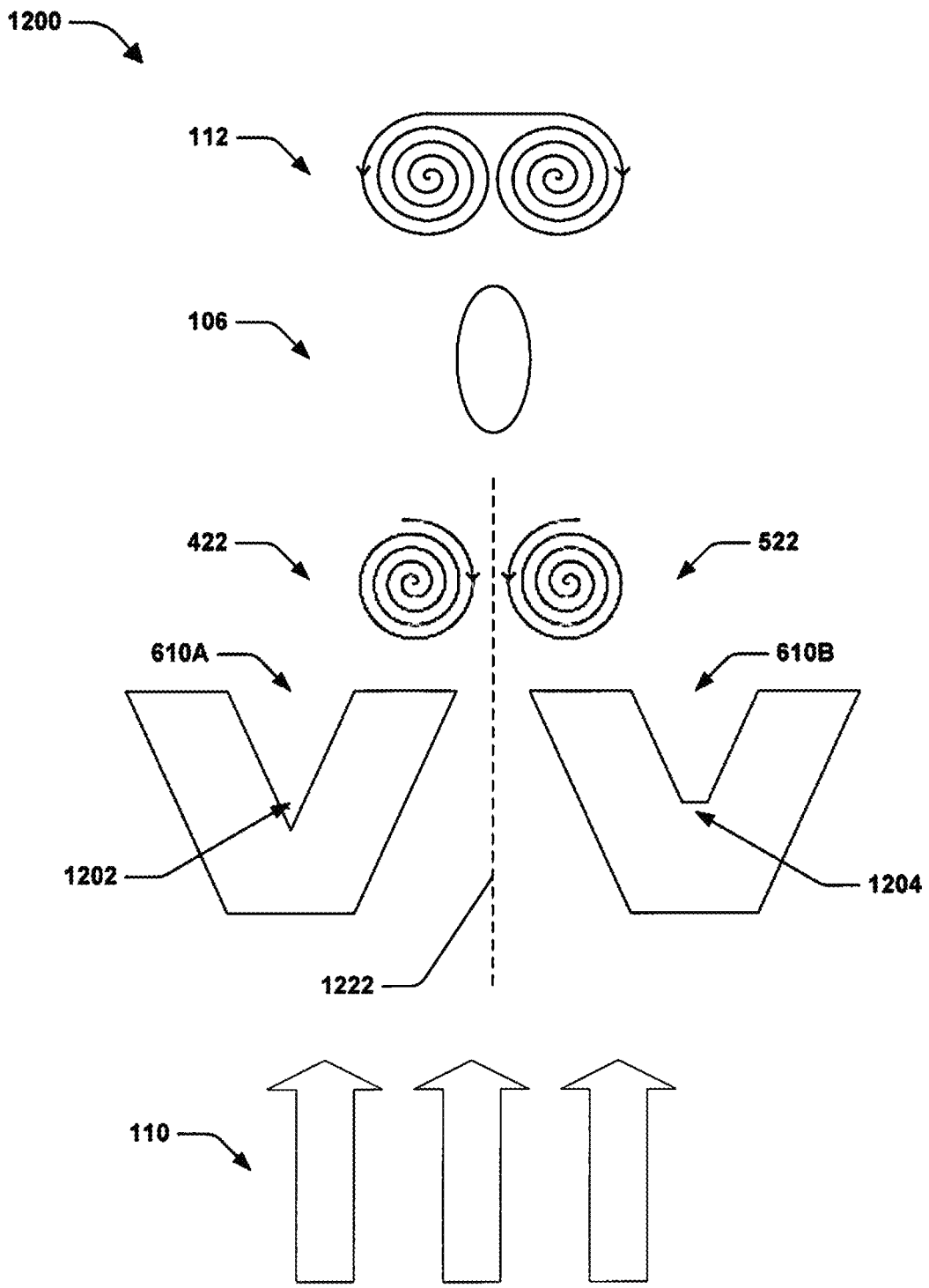
FIG. 12 is an illustration of a top-down view of one or more example shaped recesses upstream of a cooling channel, according to one or more embodiments.

FIG. 12 is an illustration of a top-down view 1200 of one or more example shaped recesses upstream of a cooling channel, according to one or more embodiments. One or more shaped recesses can be used to draw cool air from a cooling jet of a cooling channel upstream. For example, a first v-cess 610A and a second v-cess 610B can be formed upstream from a cooling channel 106. The first v-cess 610A has a sharp angle 1202 at the interior of the "V", while the second v-cess 610B has a flat edge 1204 at the interior of the "V". It will be appreciated that a v-cess can have a variety of shapes. For example, a v-cess can have a rounded, curved, tapered, staggered, etc. edge at the interior of the "V".

In one or more embodiments, two v-cesses are paired or coupled with a cooling channel 106. For example, a right leg of a first v-cess and a left leg of a second v-cess can be centered with a free stream flow 110 and the cooling channel. In other words, a shaped recess can be formed based on a set of x-coordinates or a set of y-coordinates relative to one or more additional shaped recesses, one or more cooling channels, etc. In this scenario, the first v-cess 610A and the second v-cess 610B are aligned such that vortices 422 and 522 stack with counter-rotating vortex pair 112 or a kidney vortex associated with cooling channel 106.

Additionally, one or more shaped recesses can be arranged in a row, column, etc. For example, the shaped recesses may be arranged in a row with respect to a direction of a free stream flow 110. Here, the first v-cess 610A and the second v-cess 610B are arranged in a row relative to a direction of a free stream flow 110. In this configuration, the first v-cess 610A and the second v-cess 610B can be placed upstream from the cooling channel 106 to mitigate a counter rotating vortex pair 112 associated with the cooling channel 106, thereby keeping a cooling jet (not shown) of the cooling channel 106 attached to a surface of an associated configuration. For example, the first v-cess 610A is configured to generate a first inverse counter rotating vortex 422. The second v-cess 610B is configured to generate a second inverse counter rotating vortex 522. Together, the first inverse counter rotating vortex 422 and the second inverse counter rotating vortex form an inverse counter rotating vortex pair that substantially cancels out the counter rotating vortex pair 112. In this way, film cooling can be enhanced, because the inverse counter rotating vortex pair forces the coolant jet down, keeping it 'stuck' to the surface. As a result of the coolant jet staying low to the surface, film cooling efficiency can be enhanced.

In one or more embodiments, the cooling channel 106 may be substantially centered along a centerline 1222 between the first v-cess 610A and the second v-cess 610B. Because the first v-cess 610A and the second v-cess 610B can be configured to introduce turbulence into a boundary layer of the free stream flow, the counter rotating vortex pair 112 associated with the cooling channel 106 can be mitigated. For example, the first v-cess 610A and the second v-cess 610B can be configured to create an inverse counter rotating vortex pair from 422 and 522 based on a location of the first v-cess 610A and a location of the second v-cess 610B relative to a location of the cooling channel 106.

In FIG. 12, a first v-cess 610A and a second v-cess 610B are coupled with the cooling channel 106. Although illustrated with different interiors at 1202 and 1204, it will be appreciated that a first v-cess and a second v-cess in this type of configuration may have the same shape interior, such as both having a sharp angle 1202 or both having a flat edge 1204. Additionally, the first v-cess 610A and the second v-cess 610B may be associated with corresponding interior angles.

Figure 13:
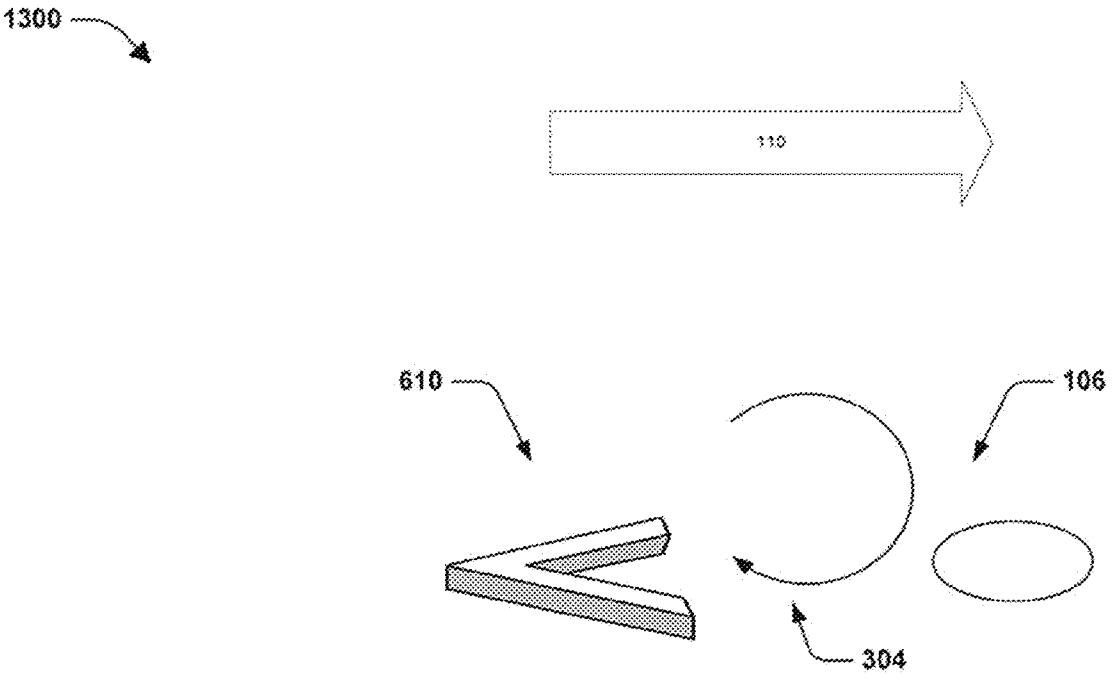
FIG. 13 is an illustration of example fluid flow associated with a "V" shaped recess (v-cess) drawing coolant upstream from a cooling channel, according to one or more embodiments.

FIG. 13 is an illustration of example fluid flow 1300 associated with a "V" shaped recess (v-cess) drawing coolant upstream from a cooling channel, according to one or more embodiments. As a result of a horseshoe structure 304 or vortex in combination with fluid effects of a shaped recess, such as a v-cess 610, cool air can be drawn upstream from a cooling channel 106. For example, high pressure associated with a horseshoe structure 304 can push a portion of flow backwards or upstream, even when the cooling channel 106 is angled away from the shaped recess or v-cess 610. Accordingly, a shaped recess, such as a v-cess 610, may be configured to draw coolant from a cooling channel 106 upstream.

Figure 14:
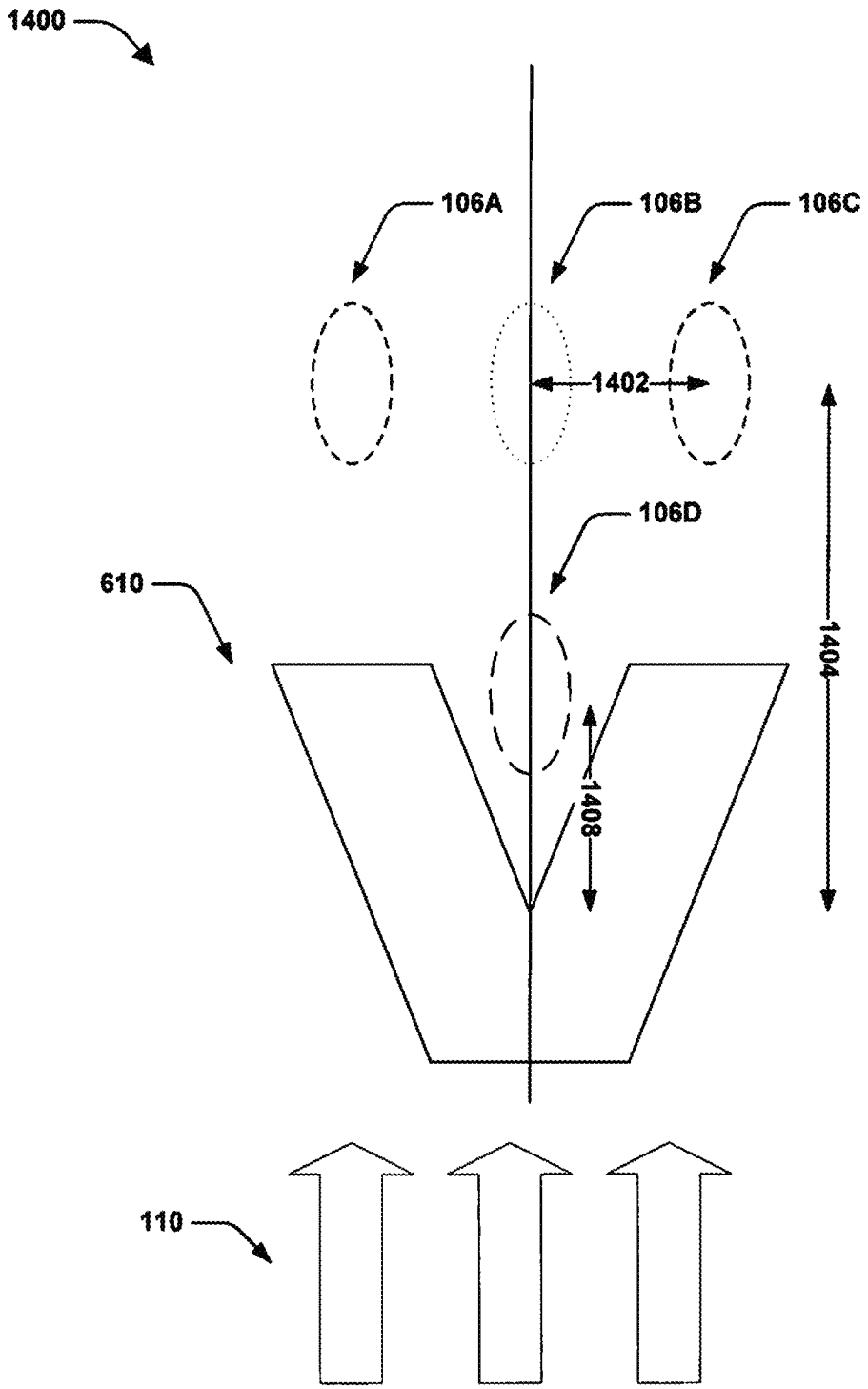
FIG. 14 is an illustration of a top-down view of an example shaped recess upstream from one or more cooling channels, according to one or more embodiments.

FIG. 14 is an illustration of a top-down view 1400 of an example shaped recess upstream from one or more cooling channels, according to one or more embodiments. A shaped recess, cooling channel, or other structure can be formed relative to another shaped recess, cooling channel, or structure. For example, a Cartesian coordinate system may be used to indicate an amount of offset one structure has with respect to another. One or more shaped recesses can be aligned with one or more cooling channels. For example, an apex of a v-cess may be aligned with a cooling channel, as seen with v-cess 610 and cooling channels 106B and 106D, offset by distances 1408 or 1404 from the apex. In one or more embodiments, a leg of a v-cess may be aligned with a cooling channel, as seen with v-cess 610 and cooling channels 106A and 106C, offset by 1402 from a centerline and 1404 from the apex of the "V" of the v-cess 610, for example. In other words, the cooling channel 106 may be offset by an x-coordinate from the v-cess 610 and a y-coordinate from the v-cess 610. Stated yet another way, a position of a cooling channel relative to a position of a shaped recess can be variable. For example, there may be an intersection of a cooling hole or cooling channel with a shaped recess or v-cess.

In one or more embodiments, a shaped recess, such as v-cess 610, can be formed upstream from a cooling channel, such as cooling channel 106A, 106B, 106C, or 106D. In other embodiments, the shaped recess can be formed downstream from the cooling channel.

In one or more embodiments, stagnation pressure adjacent to a cooling channel, such as cooling channel 106, is lower than surrounding stagnation pressure. This pressure differential enables coolant to spread laterally, for example. In other words, a v-cess 610 or shaped recess can decrease fluid velocity adjacent to a cooling channel, thereby inviting a corresponding or associated cooling jet to spread out.

Figure 15:
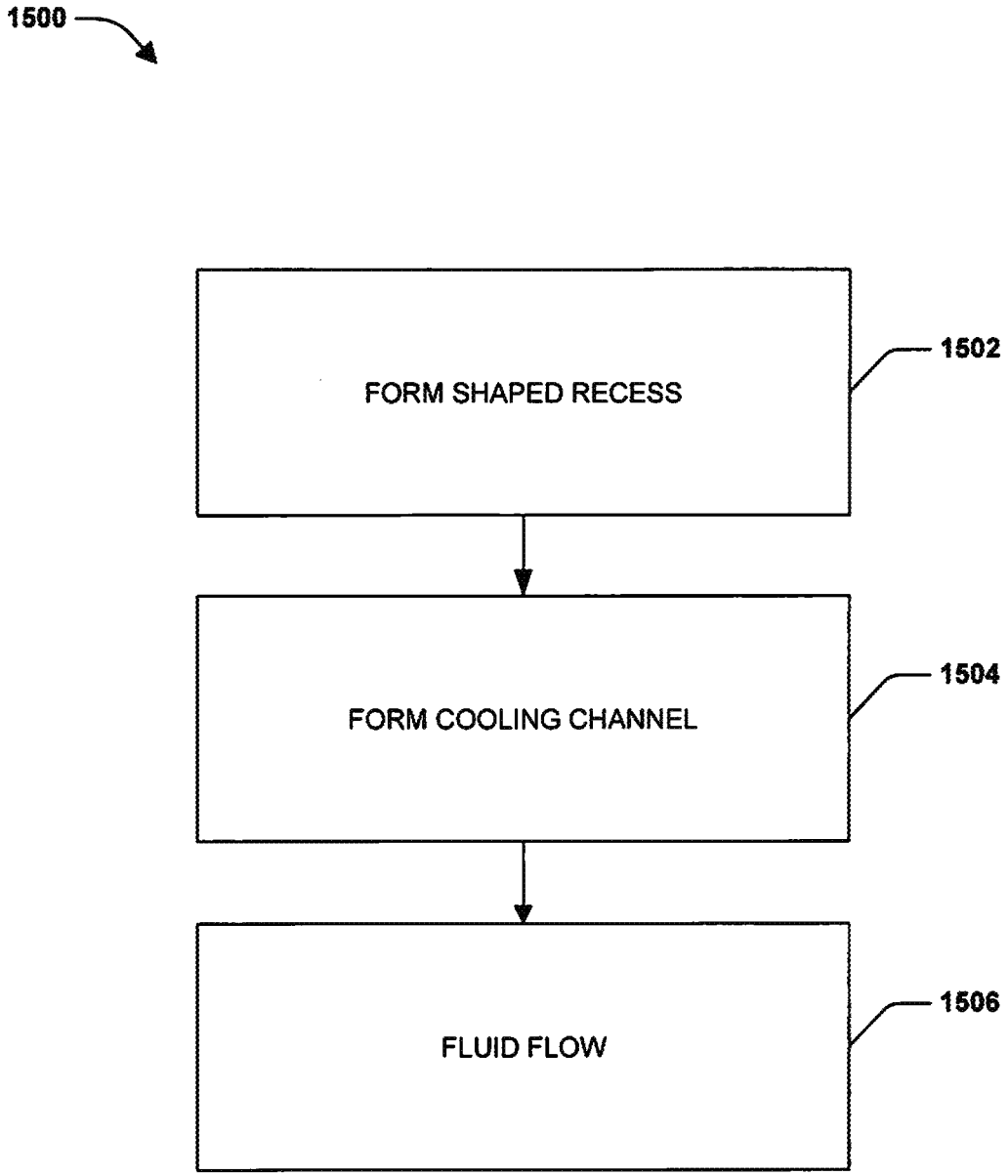
FIG. 15 is an illustration of an example flow diagram of a method for shaped recess flow control, according to one or more embodiments.

FIG. 15 is an illustration of an example flow diagram of a method 1500 for shaped recess flow control, according to one or more embodiments. In one or more embodiments, a shaped recess can be formed at 1502. The shaped recess can be a portion of a v-shaped recess or v-cess. A cooling channel can be formed at 1504, such that the cooling channel and the shaped recess are offset by a certain distance (e.g. offset by an x-coordinate and a y-coordinate). At 1506, fluid flow may commence such that there is an interaction between the shaped recess and the cooling channel.

It will be appreciated that a shaped recess can be used for flow control applications other than turbine airfoil applications, such as high pressure turbine vanes, rotor blades, and combustion liners, etc. For example, shaped recesses can be used for supersonic inlets, shock control, boundary layer control, on rotor tips, or for passive flow control applications. Additionally, a shaped recess can be used in a flow control application to energize a boundary layer, to setup counter rotating vortices, or to split an incoming flow into a high energy stream and a low energy stream close to a surface. In this way, a shaped recess can enable increased turbine inlet temperatures and improve engine cycle performance, while mitigating cost.

In one or more embodiments, a component is provided comprising a surface and a shaped recess within the surface of the component, wherein the shaped recess comprises one or more edges and a depth, wherein the shaped recess is at an angle to a direction of a free stream flow. A shape of the shaped recess can comprise at least a portion of a leg of a V shape. The shaped recess can be configured to introduce turbulence into a boundary layer of the free stream flow. The component can comprise one or more additional shaped recess arranged in a row with respect to the direction of the free stream flow. A shape of the shaped recess can comprise a V shape and the V shape may be associated with an interior angle. It will be appreciated that the shaped recess may not necessarily be four sided. For example, the shaped recess can be triangular, etc.

In one or more embodiments, a component, such as an turbine blade of a turbine airfoil can comprise a surface, a shaped recess within the surface of the component, wherein the shaped recess comprises one or more edges and a depth, wherein the shaped recess is at an angle to a direction of a free stream flow, and a cooling channel within the surface of the component, wherein the cooling channel is offset by an x-coordinate from the shaped recess and a y-coordinate from the shaped recess. The shaped recess can comprise one or more stages. For example, one or more of the stages of the shaped recess can be associated with a non-linear region or a rectangular region, etc. Additionally, one or more of the stages of the shaped recess configured to create a vorticity field downstream of the shaped recess. The shaped recess can be configured to draw coolant from the cooling channel upstream.

In one or more embodiments, a component is provided, comprising a surface, a first V shaped recess (v-cess) within the surface of the component, wherein the first v-cess comprises one or more edges and a depth, a second v-cess within the surface of the component, wherein the second v-cess comprises one or more edges and a depth, the first v-cess and the second v-cess arranged in a row relative to a direction of a free stream flow, and a cooling channel within the surface of the component, the cooling channel upstream from the row of v-cesses. The cooling channel can be substantially centered along a centerline between the first v-cess and the second v-cess. The first v-cess and the second v-cess can be configured to introduce turbulence into a boundary layer of the free stream flow. The first v-cess and the second v-cess can be associated with corresponding interior angles, comprises one or more stages, and be associated with a non-linear region or a rectangular region, etc. The first v-cess and the second v-cess can be configured to create an inverse counter rotating vortex pair.

Although the subject matter has been described in language specific to structural features or methodological acts, it is to be understood that the subject matter of the appended claims is not necessarily limited to the specific features or acts described above. Rather, the specific features and acts described above are disclosed as example embodiments.

Various operations of embodiments are provided herein. The order in which one or more or all of the operations are described should not be construed as to imply that these operations are necessarily order dependent. Alternative ordering will be appreciated based on this description. Further, it will be understood that not all operations are necessarily present in each embodiment provided herein.

As used in this application, "or" is intended to mean an inclusive "or" rather than an exclusive "or". In addition, "a" and "an" as used in this application are generally construed to mean "one or more" unless specified otherwise or clear from context to be directed to a singular form. Also, at least one of A and B and/or the like generally means A or B or both A and B. Further, to the extent that "includes", "having", "has", "with", or variants thereof are used in either the detailed description or the claims, such terms are intended to be inclusive in a manner similar to the term "comprising".

Further, unless specified otherwise, "first", "second", or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel.

Also, although the disclosure has been shown and described with respect to one or more implementations, equivalent alterations and modifications will occur based on a reading and understanding of this specification and the annexed drawings. The disclosure includes all such modifications and alterations and is limited only by the scope of the following claims.

What is claimed is:

1. An apparatus comprising:

a turbine airfoil surface;

an aperture extending through the turbine airfoil surface;

a coolant that exits the aperture and interacts with a free stream flow to form a pair of counter-rotating vortices such that the pair of counter-rotating vortices are urged to lift-off from the turbine airfoil surface and results in reduced cooling effectiveness; and a v-shaped recess located in the turbine airfoil surface, the v-shaped recess comprising:

a left leg that interrupts the free stream flow to reduce the vorticity of one of the pair of counter-rotating vortices; and a right leg that interrupts the free stream flow to reduce the vorticity of the other one of the pair of counter-rotating vortices; and wherein the v-shaped recess reduces the strength of the counter-rotating vortices, mitigates lift-off, and urges the coolant to stay in contact with the turbine airfoil surface to enhance cooling effectiveness.

2. The apparatus of claim 1, wherein the v-shaped recess comprises two diverging legs.

3. The apparatus of claim 2, wherein the v-shaped recess is configured to introduce turbulence into a boundary layer of the free stream flow.

4. The apparatus of claim 3, wherein one or more v-shaped recesses are arranged in a row with respect to the direction of the free stream flow.

5. The apparatus of claim 4, wherein the v-shaped recess comprises one or more edges and a depth.

6. The apparatus of claim 5, wherein the depth of the v-shaped recess varies along its length.

7. The apparatus of claim 6, wherein the v-shaped recess is located downstream from the aperture.

* * * * *